United States Patent [19]

Leeds et al.

[11] Patent Number: 4,575,174

[45] Date of Patent: Mar. 11, 1986

[54] ELECTRICAL CONNECTOR HOOD

[75] Inventors: Richard Leeds, Lawrence; Arthur Roberts, Westbury, both of N.Y.

[73] Assignee: Global Equipment Company, Division of Continental Dynamics Corp., Hempstead, N.Y.

[21] Appl. No.: 641,390

[22] Filed: Aug. 16, 1984

[51] Int. Cl.[4] ..... H01R 13/585

[52] U.S. Cl. ..... 339/103 M; 339/107

[58] Field of Search ..... 339/103 R, 103 M, 107, 339/210 R, 210 M

[56] References Cited

U.S. PATENT DOCUMENTS

| | | | |
|---|---|---|---|
| 3,794,960 | 2/1974 | Sugar | 339/107 |
| 4,493,523 | 1/1985 | Leong et al. | 339/103 R X |

FOREIGN PATENT DOCUMENTS

| | | | |
|---|---|---|---|
| 3046002 | 6/1982 | Fed. Rep. of Germany | 339/103 M |
| 1396790 | 6/1975 | United Kingdom | 339/103 R |
| 2109176 | 5/1983 | United Kingdom | 339/107 |

*Primary Examiner*—Eugene F. Desmond
*Attorney, Agent, or Firm*—Edward F. Levy

[57] ABSTRACT

A hood for an electrical connector employs a pair of identical body portions which are mated together to grasp the electrical connector and to provide strain relief to the exiting conductors. Strain relief is provided by a resilient or flexible strain relief tab extending angularly inward from an inner surface of each of the body portions. The strain relief tabs have sufficient resilience to permit outward deflection thereof as necessary to handle a substantial range of cable or wire bundle diameters. An optional bifurcated tip on the strain relief tab doubles the contact lines with a small cable and improves the ability of the tip to conform to the shape of a small cable or wire bundle. Ridges on the strain relief tab engage the surface of a large cable or wire bundle. The ridges may be sawteeth which are angled to resist outward forces on the cable or wire bundle. Exit channels are provided for cable exit either axially or in either of two transverse directions.

15 Claims, 5 Drawing Figures

ELECTRICAL CONNECTOR HOOD

BACKGROUND OF THE INVENTION

The present invention relates to electrical connectors and, more particularly, to protective hoods for electrical connectors.

Electrical connectors for mass connection of signals conventionally include a metal connector housing containing male or female pins through which connections are made to mating elements of a plug or jack. An insulating hood is conventionally connected to the metal housing both to provide a gripping surface for inserting and removing the connector and for strain relief for the wires exiting the connector. Strain relief is conventionally provided by either molding the mating parts of the connector to tightly fit a cable passage within the connector hood to a particular cable size or by providing a family of slip-in adapters from which a particular one can be selected to adjust the passage size to the cable size.

One such strain relief device is disclosed in U.S. Pat. No. 3,569,914 wherein a molded rigid planar member is held in gripping contact with the cable when the hood is assembled. The disclosed device is specific to the particular cable diameter used and a single hood is not adaptable to cable diameters which may range from those containing only two or three fine-gauge wires to those containing as many as fifty or more. Thus, to use the disclosed device on a range of cable sizes, a family of devices must be manufactured and stocked. This, of course, increases the design, manufacture and overhead cost of using such a hood.

One apparatus for adapting a single hood to a range of cable sizes is disclosed in U.S. Pat. No. 3,794,960 wherein a screw-driven clamp bar is urged against one side of the cable sheath to thereby capture the cable between the clamp bar and an opposed surface of a passage within the hood. This device not only requires a threaded hole in the hood, but also requires the additional parts of a clamp bar and screw. Furthermore, since the clamp bar is forcibly held in contact against a limited surface area of one side of the cable, this contact must be positioned in an area where the wires are covered by a cable sheath in order to avoid damaging the wires themselves.

The last-mentioned patent also illustrates a desirable feature of connector hoods; that is, a feature which permits exiting the cable from the hood either axially or laterally in order to adapt the cable routing to the user's needs. Lateral exit is enabled by providing for the optional installation of an external cable clamp for binding the cable to the hood and to thereby constrain the exit in one lateral direction.

A further strain relief is disclosed in U.S. Pat. No. 3,966,293 wherein the wires from the connector pins are at least partly wrapped about a strain relief member which contains comb-like depressions therein helping to hold the wires. This patent also discloses exiting the wires either axially or in either or both of two lateral directions.

OBJECT AND SUMMARY OF THE INVENTION

Accordingly, it is an object of the invention to provide a hood for an electrical connector which overcomes the drawbacks of the prior art.

It is a further object of the invention to provide a hood for an electrical connector which includes an integral strain relief.

It is a still further object of the invention to provide a hood for an electrical connector which includes a strain relief which is adaptable to a wide range of cable diameters.

It is a still further object of the invention to provide a hood for an electrical connector which permits arranging a cable exit either axially or in transverse directions.

It is a still further object of the invention to provide a hood for an electrical connector having a minimum of different parts.

Briefly stated, the present invention provides a hood for an electrical connector which employs a pair of identical body portions mated together to grasp the electrical connector and to provide strain relief to the exiting conductors. Strain relief is provided by a resilient or flexible strain relief tab extending angularly inward from an inner surface of each of the halves. The strain relief tabs have sufficient resilience to permit outward deflection thereof necessary to handle a substantial range of cable or wire bundle diameters. An optionally bifurcated tip on the strain relief tab doubles the contact lines with a small cable and improves the ability of the tip to conform to the shape of a small cable or wire bundle. Ridges on the strain relief tab engage the surface of a large cable or wire bundle. The ridges may be sawteeth which are angled to resist outward forces on the cable or wire bundle. Exit channels are provided for cable exit either axially or in either of two transverse directions.

According to an embodiment of the invention, there is provided a hood for a connector of the type adapted for connection thereto of at least one conductor comprising a body portion, an opposing member affixed to the body portion, the at least one conductor being disposable between the body portion and the opposing member, means at a first end of the body portion for grasping the connector, means at a second end of the body portion for exiting the at least one conductor, a strain relief tab in the body portion, the strain relief tab extending from the body portion angularly toward the at least one conductor and toward the connector, means on the strain relief tab for resiliently urging the at least one conductor toward the opposing member and for resisting an an outward force applied to the at least one conductor, and the strain relief tab being of resilient material effective for permitting a substantial lateral deflection thereof by contact with the at least one conductor whereby a substantial range of diameters of the at least one conductor is accommodated.

According to a feature of the invention, there is provided a hood for an electrical connector of the type adapted for the connection thereto of a plurality of conductors comprising substantially identical first and second body portions, means in the first and second body portions for mutual alignment into a hood having a first end and a second end, means in the first end for grasping the electrical connector, an axial exit channel in the second end for permitting axially dressing at least some of the plurality of conductors, first and second transverse exit channels in the second end for permitting selectively dressing at least some of the plurality of conductors in either of first and second transverse directions, the first and second body portions being molded of a plastic material, a strain relief tab on each of the first and second body portions intermediate the first and second ends, the strain relief tab being inwardly inclined toward the plurality of conductors in the hood and toward the connector, an opening in each of the first and second body portions generally aligned with at least a part of its respective strain relief tab, a bifurcating groove in a tip of the strain relief tab effective for dividing the tip into first and second contact lines for contact with the plurality of conductors and at least one sawtooth ridge on a surface of the strain relief tab, the at least one sawtooth ridge being effective for contacting a surface of the plurality of conductors when the strain relief tab is deflected a predetermined amount by a plurality of conductors having a diameter exceeding a predetermined value.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

The following description details embodiments of the invention adapted for use with a particular type of connector and a particular type of cable in order that the description herein may be as concrete as possible. It must be realized, however, that the hood of the present invention may equally be adapted in size and shape for employment with other types of cables and connectors without departing from the spirit and scope of the invention.

Figure 1:
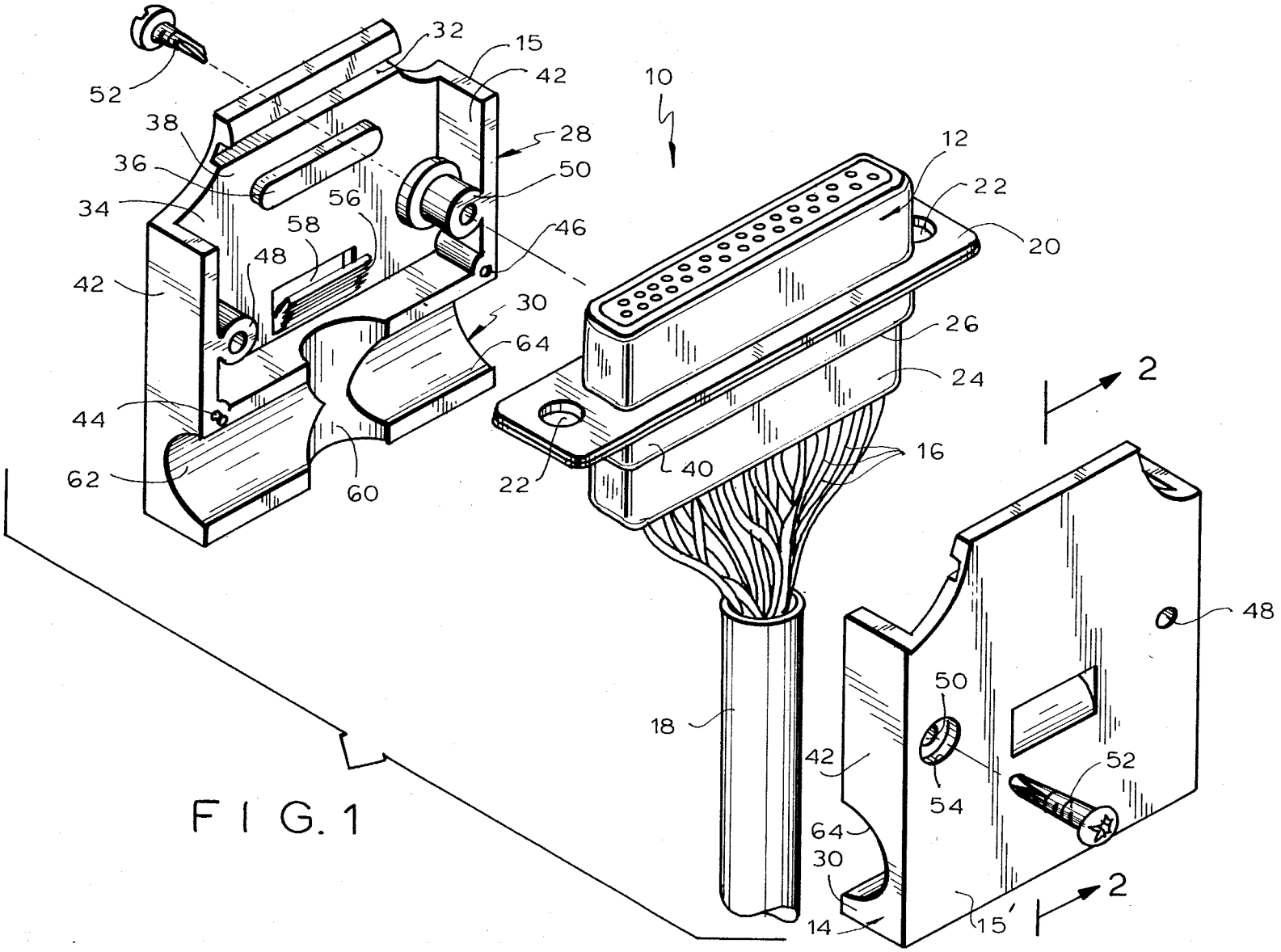
FIG. 1 is a perspective view of an electrical connector with attached cable and a hood according to an embodiment of the invention.

Referring now to FIG. 1, a connector 10 is shown which consists of a connector body 12, a portion of which is gripped and enclosed by a hood 14 consisting of identical body portions 15 and 15'. A plurality of wires 16 are connected within connector body 12 and exit to be bundled within a cable sheath 18 which protects wires 16 in their run to their destination.

Figure 2:
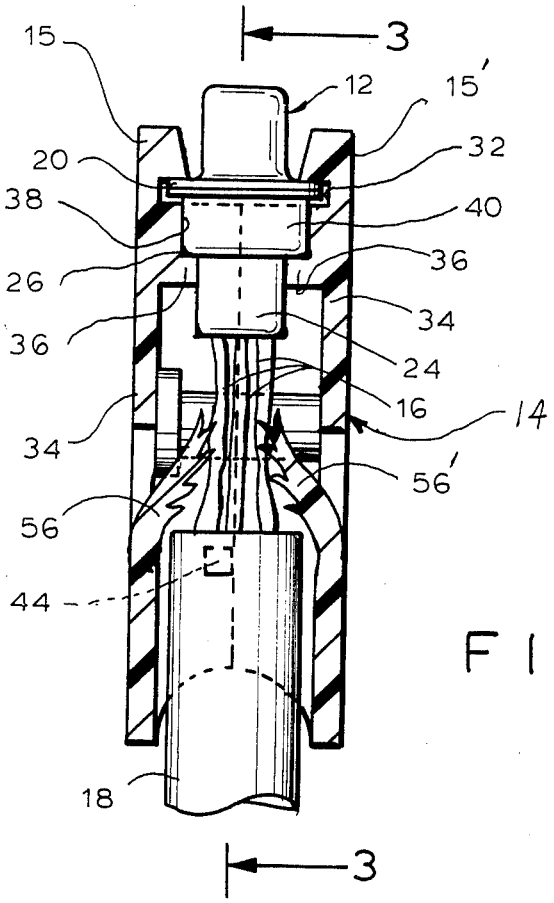
FIG. 2 is an axial cross section of the elements of FIG. 1 in their assembled condition taken along II—II of FIG. 1.

Connector body 12 conventionally includes a flange 20 about its midsection. A mounting hole 22 is conventionally included in each extremity of flange 20 for accepting a mounting screw (not shown) which may be employed for affixing connector 10 to a mating connector (not shown). An insulating block 24 extends axially beyond connector body 12. Insulating block 24 conventionally has a narrower width than does the contiguous portion of connector body 12. As also seen in FIG. 2, this change in width produces a step 26 of which advantage is taken in interfacing hood 14 to connector body 12.

Body portion 15 (as well as identical body portion 15') includes an upper portion 28 and a lower portion 30. Upper portion 28 includes a groove 32 positioned to engage flange 20 of connector body 12. A wall 34 includes a boss 36 which, as best seen in FIG. 2, engages insulating block 24 below step 26. An intermediate wall portion 38 between groove 32 and boss 36 is positioned to contact and stabilize a portion 40 of connector body 12 between flange 20 and step 26. The engagement between connector body 12 and body portions 15 and 15' is effective to secure connector body 12 against axial forces tending to disconnect them. Side walls 42 on body portions 15 and 15' contact contiguous ends of connector body 12 and prevent substantial transverse motion of connector body 12 with respect to hood 14.

A stabilizing stud 44 extends outward from body portion 15 to engage a mating hole 46 (hidden) in body portion 15'. A mating hole 46 is positioned to engage a corresponding stabilizing stud 44 (hidden) in body portion 15'. Depending on the material from which hood 14 is manufactured, stabilizing stud 44 may be a plastic or metallic insert or may be integrally molded at the same time that the parts of hood 14 are formed. In the embodiment of FIGS. 1 and 2, wherein hood 14 is molded of synthethic resin, stabilizing stud 44 is preferably integrally molded. Similarly, hole 46 is also preferably integrally molded.

An annular stud 48 is integrally molded into one side of upper portion 28. Annular stud 48 faces a second annular stud which is sized to permit the passage of a self-tapping screw 52 therethrough. A counterbore 54 may be provided at the entry of annular stud 50 to provide a recess into which the head of self-tapping screw 52 may fit. Due to the stability of assembly provided by stabilizing stud 44 and hole 46, only two self-tapping screws 52 are required in the preferred embodiment of the invention.

A flexible strain relief tab 56 curves or is inclined inward from wall 34. A rectangular opening 58 is optionally included in wall 34 to provide space into which flexible strain relief tab 56 may be moved, as will be explained.

Lower portion 30 contains an integrally molded axial half channel 60 and integrally molded transverse half channels 62 and 64 which, when body portion 15 and body portion 15' are mated together, form generally cylindrical channels for the passage of cable sheath 18 in a selectable one of three directions.

Figure 3:
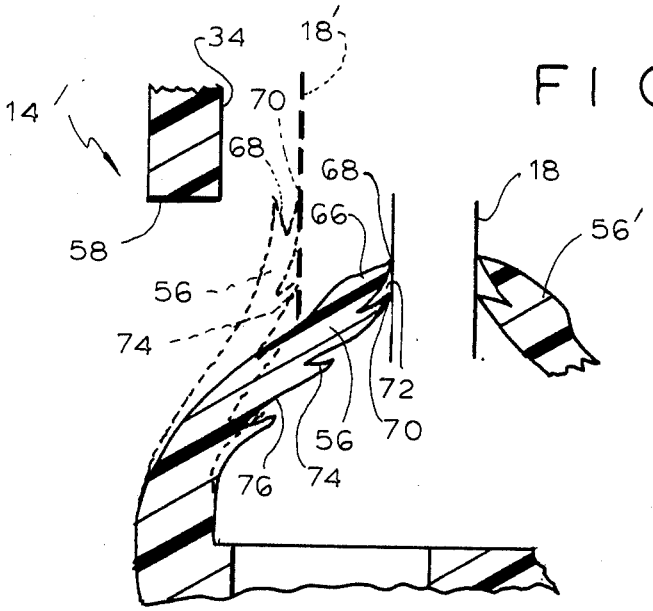
FIG. 3 is a closeup view of a portion of FIG. 2 showing the strain relief tab in greater detail.

Referring now to FIG. 3, flexible strain relief tab 56 (and a portion of an opposing flexible strain relief tab 56') is shown. Hood 14 is preferably molded of a substantially rigid resin such as, for example, polyethylene or other suitable plastic material. The thicknesses used in flexible strain relief tab 56 are small enough to permit resilient deflection thereof a substantial transverse distance without breaking. Flexible strain relief tab 56 is shown in its partially deflected position in solid line with appropriate hatching. An extremity 66 of flexible strain relief tab 56 is bifurcated to provide a first contact line 68 and a second contact line 70 separated by a groove 72. When hood 14 is assembled about a cable sheath 18 having a relatively thin cross section or, alternatively, when flexible strain relief tab 56 contacts wires 16 directly at a point where wires 16 are not covered by cable sheath 18, the tips of contact line 68 and contact line 70 contact wires 16. Contact line 68 and contact line 70 are molded to have a relatively fine tip line for engaging insulation on cable sheath 18 or wires 16. In addition, contact line 68 and contact line 70 are inclined at an angle pointing axially inward to thereby resist a tendency for cable sheath 18 to be pulled outward from connector 10 and to thereby place a strain on wires 16 particularly where they are joined to connector pins. The bifurcated narure of extremity 66 performs two functions:

1. provides two lines of contact with a small-diameter cable sheath 18, and
2. the presence of groove 72 reduces the stiffness of the plastic in this region so that it is better able to conform to the small cross section of cable sheath 18.

A plurality of sawtooth ridges 74 are disposed on an inner surface 76 of flexible strain relief tab 56. The sawtooth shapes of sawtooth ridges 74 are inclined inward against the direction of exit of cable sheath 18. When a small-diameter cable sheath 18, such as that shown in solid line, is gripped by flexible strain relief tab 56 and flexible strain relief tab 56', inner surfaces 76 remain out of contact with cable sheath 18. Conversely, when a larger diameter cable, such as, for example a cable sheath 18' (shown in dashed line) is gripped, flexible strain relief tab 56 is more fully deflected outward. This outward deflection may proceed sufficiently so that contact line 68 and contact line 70 may be aligned parallel to the surface of cable sheath 18' and to thereby lose any possibility of biting contact with cable sheath 18'. However, with the deflection shown, one or more of sawtooth ridges 74 are brought into biting contact with the surface of cable sheath 18' (or wires 16) to resist outward forces on cable sheath 18'. In the more fully deflected position of flexible strain relief tab 56 shown, the force applied by flexible strain relief tab 56 on cable sheath 18' is appropriately greater to thereby provide greater resistance to the larger forces which may be expected to be applied to larger cables.

It would be clear to one skilled in the art that the bifurcation of extremity 66 flexible strain relief tab 56 may be omitted and a plain tip (not shown) may be substituted therefor. In addition, sawtooth ridges 74 may be replaced with plain ridges, or may be omitted altogether. The most preferred embodiment of the invention employs a plain, unbifurcated, tip on extremity 66 and either plain ridges or no ridges on inner surface 76.

Returning now to FIGS. 1 and 2, cable sheath 18 may be dressed to exit axially through the mated pair of axial half channels 60 or may be dressed to exit transversely either left or right through mated pairs of transverse half channels 62 or transverse half channels 64. When transverse exit is employed, not only is the exit direction of cable sheath 18 arranged for the user's convenience, but also, the strain-relief function of connector 10 is further enhanced.

Figure 4:
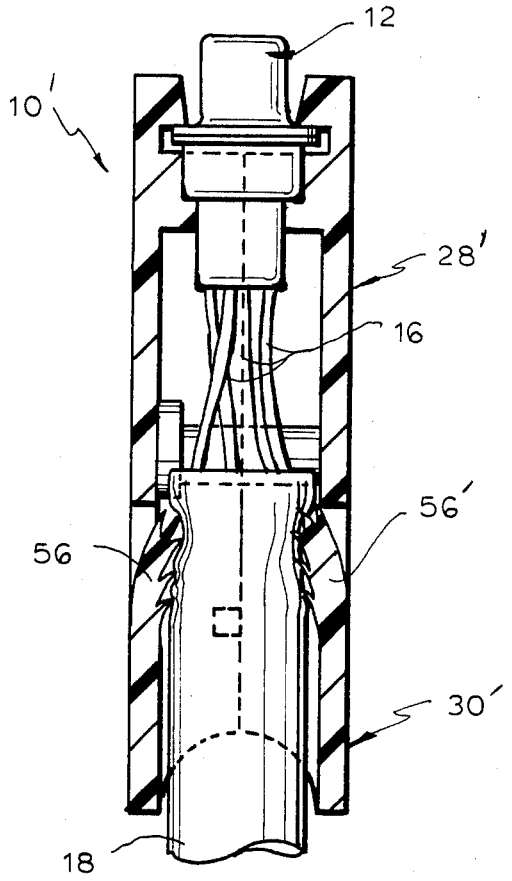
FIG. 4 is an axial cross section of an electrical connector with attached cable and hood according to a second embodiment of the invention.

The embodiment of the invention shown in FIGS. 1, 2 and 3, when used on a cable using many wires 16 which enter a cable sheath 18, is dimensioned to contact wires 16 with flexible strain relief tabs 56. Referring now to FIG. 4, a connector 10' is shown in which an upper portion 28' is elongated compared to upper portion 28 of FIGS. 1, 2 and 3. This elongation repositions flexible strain relief tabs 56 further away from connector body 12 whereby flexible strain relief tabs 56 may contact cable sheath 18 rather than wires 16. The embodiment of the invention in FIG. 4 functions in the same manner as the embodiment previously described.

Figure 5:
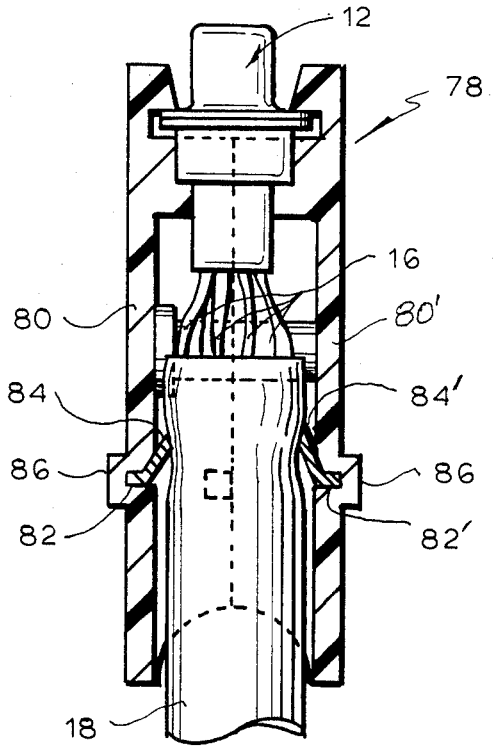
FIG. 5 is an axial cross section of an electrical connector with attached cable and hood according to a further embodiment of the invention.

Referring now to FIG. 5, a connector 78 is shown in which first and second body portions 80 and 80' are mateable to a connector body 12 in the manner previously described. Grooves 82 and 82' in body portions 80 and 80' each contain a strain relief tab 84. Strain relief tabs 84 are angled inward to resist outward forces on the cable. A thickened ridge 86 may optionally be provided to increase the depth of material in the vicinity of grooves 82 and 82'. Strain relief tabs 84 and 84' are of a material having substantial resilience to thereby resiliently contact cable sheath 18 for providing strain relief.

Body portions 80 and 80' are shown hatched for plastic resin and strain relief tabs 84 are shown hatched for metal. Strain relief tabs 84 may be molded in place when body portions 80 and 80' are formed or they may be separately placed in grooved 82 and 82' after body portions 80 and 80' are molded.

Instead of being formed of a plastic resin, body portions 80 and 80' may be made of metal by any convenient method such as, for example, by die casting. When body portions 80 and 80' are made of metal, strain relief tabs 84 may be integrally formed or, as in the embodiment of FIG. 5, they may be molded in place of a different material or may be assembled into body portions 80 and 80' after the parts are formed.

Although connector 10 and connector 78 have been illustrated and described in embodiments in which a pair of identical parts are mated to form a hood, this should not be considered to limit the invention. For example, one of the body portions may be replaced by a flat plate to close the opening in the remaining body portion. The flat plate requires appropriately shaped grooves and bosses to grasp a connector body 12. In such an embodiment of the invention, only one flexible strain relief tab 56 (or strain relief tab 84) may be available to provide strain relief. In certain applications, however, a single flexible strain relief tab 56 (strain relief tab 84) may provide adequate strain relief and such an embodiment should be considered part of the invention.

In addition, although the embodiments shown have been applied to cables of individual wires bundled into a substantially cylindrical sheath, the present invention is equally applicable to flat cables in which a plurality of wires are molded into a flat, plastic-encased assembly.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A hood for a connector of the type adapted for connection thereto of at least one conductor comprising:

a pair of complementary body portions each having a flat wall surface and a flexible strain relief tab projecting at an inclined angle from said wall surface;

means at a first end of each said body portion for grasping said connector;

an outlet opening at a second end of each said body portion for exiting said at least one conductor;

means for securing together said body portions in an assembled condition about said conductor to form a hollow hood body with said wall surfaces spaced from each other and said strain relief tabs aligned with each other and inclined toward each other in a direction toward said connector and away from said outlet opening;

a flat linear edge on each of said strain relief tabs for engaging and gripping said at least one conductor in a wedging action for resisting an outward force applied to said at least one conductor in a direction generally away from said connector; and said strain relief tabs being of resilient material effective for permitting a substantial lateral deflection thereof by contact with said at least one conductor whereby a substantial range of diameters of said at least one conductor is accommodated.

2. A hood according to claim 1 wherein said body portion and said strain relief tab are integrally formed of a plastic material.

3. A hood according to claim 2 wherein said body portion includes an opening generally aligned with at least a portion of said strain relief tab whereby said strain relief tab may be transversely deflected at least partly into said opening by contact with said at least one conductor.

4. A hood according to claim 1 wherein said body portion is of one of a metal and a plastic material and said relief tab is of the other of said metal and said plastic material.

5. A hood according to claim 4 wherein said body portion is of plastic material, said body portion includes a groove therein and said strain relief tab is a resilient metal tab affixed in said groove.

6. A hood according to claim 5 wherein said resilient metal tab is integrally molded in said groove.

7. A hood according to claim 5 wherein said groove is molded in said body portion and said resilient metal tab is assembled in said groove.

8. A hood according to claim 1 wherein each of said body portions includes a stabilizing stud directed toward the other thereof and a hole into which said stabilizing stud from the other thereof is fittable when said body portions are fitted together.

9. A hood according to claim 1 wherein said strain relief tab is of plastic material and said linear edge includes a bifurcating groove in a tip of said strain relief tab effective to divide said tip into first and second contact lines for contacting said at least one conductor.

10. A hood according to claim 9, wherein said linear edge further includes at least one ridge on a lateral surface of said strain relief tab, said ridge being inclined inward to resist outward force on said at least one conductor, said at least one ridge being urged into contact with a surface of said at least one conductor by outward deflection of said strain relief tab by contact with said at least one conductor having greater than a predetermined diameter.

11. A hood according to claim 1 wherein said means for exiting said at least one conductor includes at least one axial channel and at least one transverse channel in said end, said at least one conductor being selectably dressable in either one of said at least one axial channel and said at least one transverse channel.

12. A hood according to claim 11 wherein said at least one transverse channel includes first and second aligned transverse channels, said first transverse channel exiting said at least one conductor in a first transverse direction and said second transverse channel exiting said at least one conductor in a second opposed transverse direction.

13. A hood for an electrical connector of the type adapted for the connection thereto of a plurality of conductors comprising:

substantially identical first and second body portions;

means in said first and second body portions for mutual alignment into a hood having a first end and a second end;

means in said first end for grasping said electrical connector;

an axial exit channel in said second end for permitting axially dressing at least some of said plurality of conductors;

said first and second transverse exit channels in said second end for permitting selectively dressing at least some of said plurality of conductors in either of first and second transverse directions;

said first and second body portions being molded of a plastic material;

a strain relief tab on each of said first and second body portions intermediate said first and second ends for resisting an outward force applied to said conductor in a direction away from said first end;

said strain relief tab being inwardly inclined toward said plurality of conductors in said hood and toward said connector; and each of said strain relief tabs including means for applying a resistive force to said conductor at an acute angle to said outward force, in a direction generally opposite to that of said outward force whereby said conductor is retained in place within said hood, and is not shifted therefrom by said outward force.

14. A hood according to claim 13, further comprising:

a bifurcating groove in a tip of said strain relief tab effective for dividing said tip into first and second contact lines for contact with said plurality of conductors; and at least one sawtooth ridge on a surface of said strain relief tab, said at least one sawtooth ridge being effective for contacting a surface of a plurality of conductors when said strain relief tab is deflected a predetermined amount by a plurality of conductors having a diameter exceeding a predetermined value.

15. A hood according to claim 14, further comprising an opening in each of said first and second body portions generally aligned with at least a part of its respective strain relief tab.

* * * * *